United States Patent [19]

Farnworth et al.

[11] 4,179,175

[45] Dec. 18, 1979

[54] SAFETY SOCKET

[76] Inventors: Ivan A. Farnworth, 441 S. State; Ivan R. Farnworth, 946 S. 500 East, both of Orem, Utah 84057

[21] Appl. No.: 947,995

[22] Filed: Oct. 2, 1978

[51] Int. Cl.[2] ..... H01R 13/44; H01R 33/30

[52] U.S. Cl. ..... 339/42; 200/51.09

[58] Field of Search ..... 339/42, 111; 200/51.09, 200/51.1

[56] References Cited

U.S. PATENT DOCUMENTS 3,843,854 10/1974 Mori et al. ..... 200/51.09

*Primary Examiner*—Neil Abrams

*Attorney, Agent, or Firm*—Criddle, Thorpe & Western

[57] ABSTRACT

A safety socket assembly comprising a non-conductive housing containing a conductive pair of prong sheaths each having a facing aperture on the inside portion thereof and one of the prong sheaths having a slidable contact thereon. A pair of electrical terminals are provided one of which is connectable with its corresponding prong sheath only by means of the slidable contact. A self-locking displaceable peg connected to the slidable contact is situated between the prong sheaths and is locked in position by locking means which extend into the apertures in the prong sheath. The prongs of a plug inserted into the prong sheaths release the locking means allowing the plug to move the peg and slidable contact backwardly until the contact comes into contact with its terminal thereby energizing the socket. Removal of the plug causes the peg and slidable contact to move forwardly to the locking position thereby de-energizing the socket.

7 Claims, 3 Drawing Figures

SAFETY SOCKET

BACKGROUND OF THE INVENTION

This invention relates to a safety electrical socket of the wall outlet type. More specifically, this invention relates to a safety electrical socket which can only be energized by depression of a locked peg situated between the prong holes of the socket wherein the peg can only be unlocked by inserting the prongs of a plug into both of the prong holes of the socket.

The numerous hazards presented by conventional electrical sockets are well known and documented. Many accidents and fatalities occur as a result of children inserting electricity conducting objects into the prong holes of the socket. Various safety sockets have been devised to rectify these problems. Some require additional pieces of equipment to be added to a conventional wall outlet as shown by U.S. Pat. No. 3,942,856. Others require a degree of manual dexterity or manipulation to energize a socket such as the rotational displacement sockets shown in U.S. Pat. Nos. 3,668,607 and 4,037,901.

OBJECTS AND BRIEF DESCRIPTION OF THE INVENTION

It is an object of the present invention to provide a safety electrical socket which can be energized simply by inserting an electrical plug therein.

It is also an object of this invention to provide a safety socket that can only be energized by depressing and holding in position a displaceable electrical contacting means which means can only be depressed when locking means in both prong holes of a socket are released by prongs of an electrical plug or similar objects being inserted into both prong holes of the socket.

Another object of this invention is to provide a safety electrical socket wherein locked displaceable electrical contacting means are positioned in the socket between the prong holes such that an electrical plug being inserted into the socket can simultaneously unlock and depress the locked displaceable electrical contacting means and energize the socket.

A still further object of this invention is to provide a safety electrical socket wherein, without the aid of a plug, the manual dexterity required to energize the socket is beyond that possessed by most small children.

These and other objects may be accomplished by means of an electrical socket comprising a non-conductive housing into which are positioned (1) parallel conductive metal sheaths adapted to receive the prongs of an electrical plug, (2) terminals electrically connectable to the metal sheaths and (3) a spring loaded displaceable peg situated in between the metal sheaths which, when depressed, electrically connects one metal prong sheath with its corresponding terminal. The displaceable peg is locked in a forward position by locking means tensioned in a transverse aperture in the peg which aperture is in alignment with apertures in the inside walls of the prong sheaths. The locking means extends through the sheath wall aperture into the prong hole and prevents the backward movement of the displaceable peg until the locking means has been forced out of both prong holes by means of an object, such as the prongs of a plug, being inserted therein. A slidable contact encircles one prong sheath and is connected to the displaceable peg. When the peg is in its forward locked position the slidable contact and metal sheath are not electrically connected to the corresponding terminal. When the prongs of a plug are inserted into the prong holes formed by the metal sheaths, the prongs cause the locking means to compress thereby receding out of the prong holes. This action releases the displaceable peg which is contacted by the flat front insulated end of the plug and pushed backwardly into the socket housing. As the peg moves backwardly, the slidable contact also moves on the sheath and comes into contact with the corresponding terminal thereby energizing the socket. When the plug is removed from the socket, the peg moves forwardly under spring pressure and the slidable contact also moves forwardly away from the terminal thereby opening the circuit and de-energizing the socket. At the end of the forward movement of the peg, the locking means snap through the apertures in the sheath walls locking the peg in position. The peg extends outwardly from the front surface of the socket housing so that it can be displaced backwardly when an electrical plug is inserted into the socket.

DRAWINGS

DETAILED DESCRIPTION OF THE INVENTION

Figure 3:
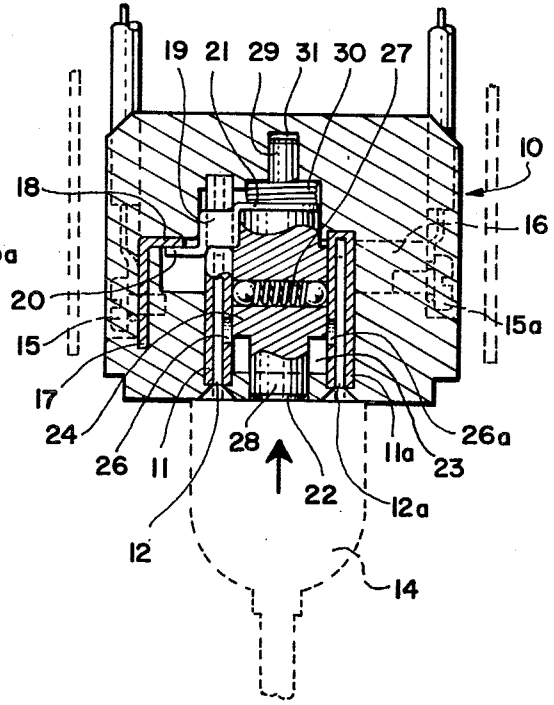
FIG. 3 is a top cross-sectional view as shown in FIG. 2 with an electrical plug, shown in phantom lines, being fully inserted therein.
Figure 2:
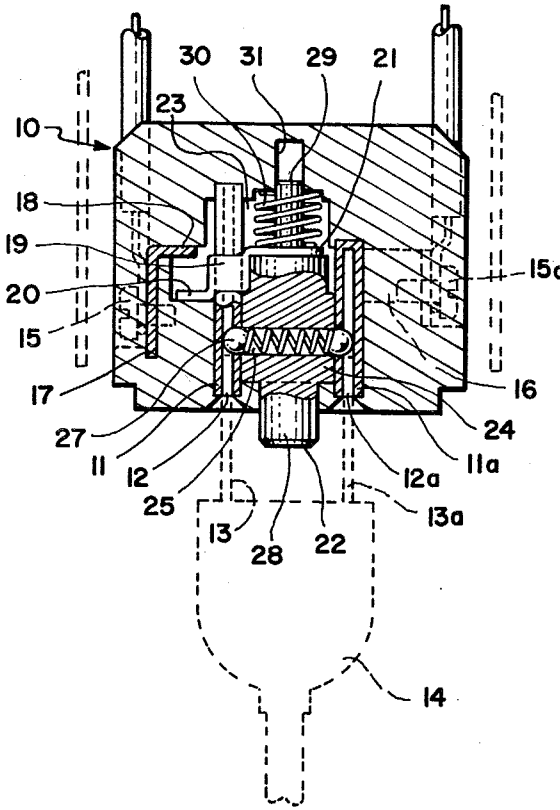
FIG. 2 is a top cross-sectional view of the safety socket taken along lines 2—2 of FIG. 1 with an electrical plug, shown in phantom lines, being inserted so that the plug prongs meet the locking means.
Figure 1:
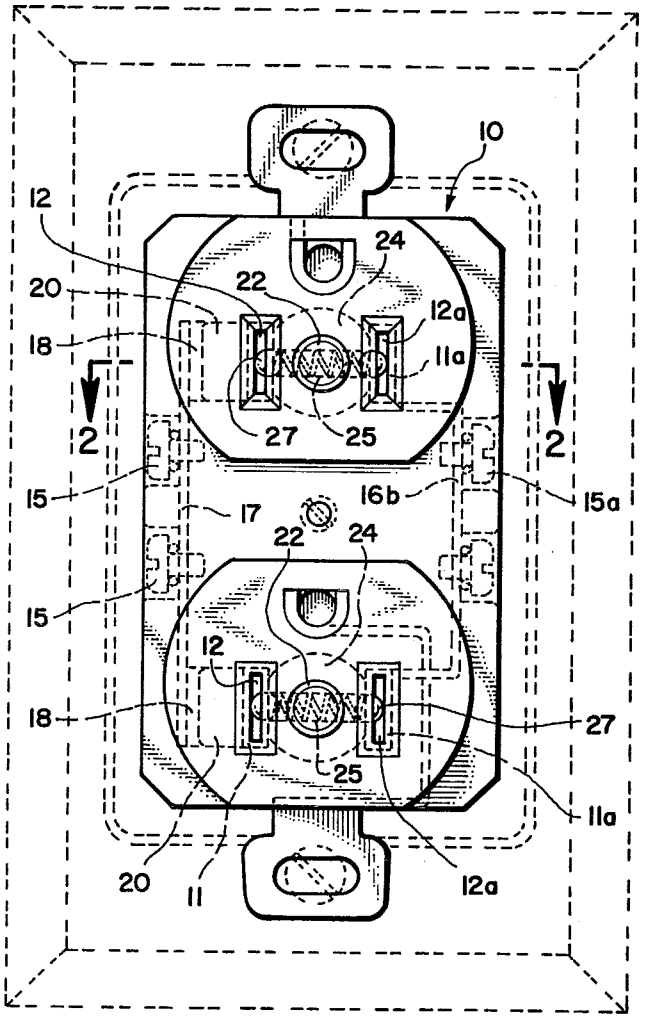
FIG. 1 is a front elevational view of a safety socket in the form of a wall outlet showing the locking means in the prong holes and the displaceable peg locked in position. The terminals, slidable contact, and the peg aperture housing the locking means are shown in phantom lines.

There is shown in FIGS. 1–3 a complete operative embodiment of the invention. While the invention may be utilized in any of the various forms into which an electrical plug can be inserted, it will be described herein in terms of a conventional wall outlet containing a double socket. The cooperative elements of the invention are contained in a non-conductive housing 10 which is preferably made of a thermosetting resin such as urea-formaldehyde. Positioned in the housing in parallel relationship and having open forward ends, are metal prong sheaths 11 and **11*a* forming prong holes 12 and 12*a* into which the prongs 13 and 13*a* of an electrical plug 14 may be inserted. Electric terminals 15 and 15*a* are positioned into the sides of housing 10. Terminal 15*a* is directly connected to sheath 11*a* by a metal connector strip 16. Terminal 15 contains a metal connecting strip 17 which is not directly connectable to prong sheath 11. Rather, connecting strip 17 contains a contact tab 18 which is perpendicular and adjacent to the rear portion of prong sheath 11. Situated about prong sheath 11 in a cavity in the housing 10, is a slidable contact 19 having an outwardly extending forward tab 20 and an inwardly extending rear tab 21. Tabs 18, 20 and 21 are in the same parallel plane. Tabs 18 and 20 overlap so that when slidable contact 19 is moved backwardly about prong sheath 11, as will be described, tabs 18 and 20** come into contact to energize the socket and allow the passage of electrical current therethrough.

The energizing of the socket is controlled by a safety mechanism involving a displaceable peg 22 positioned in a peg cavity 23 located between and in axial alignment with the prong sheaths 11 and 11*a*. Peg 22 may be of any general shape but is preferably circular and of varying diameter. Peg 22 has a larger central area 24 which has a diameter larger than the space between the prong sheaths and has flat sides such that the central portion may fit between the prong sheaths with the flat sides being adjacent thereto. A transverse aperture 25 extends across central portion 24 from one flat side to the other and is in alignment with apertures 26 and 26*a* in the inside walls of prong sheaths 11 and 11*a* when the peg 22 is in its forward position. A locking mechanism 27 consisting of a spring having solid, round, or ball-like tips at each end is carried in transverse peg aperture 25. The tips are adapted to extend through the apertures 26 and 26*a* in the prong sheath walls and into the prong holes 12 and 12*a* thereby locking the peg 22 into a forward position. The tips are so shaped that the backward portion thereof will engage the rear portion of apertures 26 and 26*a* in the sheath walls and resist backward movement of peg 22 when in a forward locked position. The tips are rounded such that when an electrical plug 14 is inserted into the socket the prongs 13 and 13*a* will push by the tips of the locking means 27 causing them to move inwardly out of the prong holes thereby compressing the spring located in the peg. When backward pressure is placed on the peg, the tips will recede out of the sheath apertures 26 and 26*a* into the peg aperture 25, thus unlocking the peg.

The forward portion 28 of peg 22 is preferably smaller in diameter than central portion 24 and extends forwardly out of peg cavity 23, and the front surface of housing 10, a distance equal to the distance terminal contact tab 18, is separated from slidable contact tab 20. The rear portion 29 of the peg 22 is also smaller than the central portion 24. The rear portion 29 of peg 22 fits through an aperture in tab 21 of slidable contact 19 such that tab 21 is seated against the end of central peg portion 24 and held in place by a peg spring 30 that fits about rear peg portion 29, said spring being interposed in peg cavity 23 between tab 21 and the cavity end wall. A cavity extension 31 is added at the rear of cavity 23 into which the rear portion 29 of peg 22 fits and acts as a guide for keeping peg 22 in axial alignment.

With the various parts of the safety socket defined, its mode of operation will now be explained. When the socket is in a de-energized or safe position, peg 22 is tensioned forward by means of peg spring 30. Peg 22 is locked in this position by the locking mechanism 27. Peg aperture 25 is in alignment with sheath apertures 26 and 26*a*, allowing the tips of locking mechanism 27 to expand through the sheath apertures into prong holes 12 and 12*a*. Slidable contact 19 is movable with peg 22 and when peg 22 is locked in its forward position, contact tab 18 of terminal 15 and contact tab 20 of the slidable contact are separated, thereby preventing the potential flow of electricity through the socket until the peg 22 is rearwardly displaced.

With the socket thus assembled, it will be extremely difficult for a small child to energize the socket. Even though a child may insert a wire, nail or similar object into each prong hole, the socket will still not be activated until peg 22 is depressed connecting tabs 18 and 20. The manual dexterity required to do this is too advanced for most children. Objects must be inserted into both prong holes to retract the tips of the locking mechanism before peg 22 can be depressed.

The socket can easily be energized with an electrical plug. The locking mechanism 27 is so positioned in the socket that the prongs 13 and 13*a* of a plug 14 contact the tips of the locking mechanism, forcing them out of the prong holes before the end of the plug 14 reaches the outer end of peg 22. Since peg 22 is unlocked by the time the plug reaches it, the peg 22 and slidable contact 19 are rearwardly displaced as the plug 14 and prongs 13 and 13*a* are fully inserted into the socket with the end of the plug touching the face of socket housing 10. The rearward movement of slidable contact 19 with peg 22 causes tabs 18 and 20 to come into electrical contact thereby energizing the socket until the plug is removed and the peg and slidable contact returned to the forward locked position under spring pressure.

While the invention has been described in its preferred embodiment, various modifications and changes may be made without departing from the scope of the invention which is to be limited only by the appended claims. For example, the same safety features can be readily applied to a 220 volt socket by one having ordinary skill in the art.

We claim:

1. A safety socket assembly comprising a non-conductive housing having mounted therein two parallel conductive prong sheaths having facing apertures on the inside walls thereof and corresponding electrical terminals wherein one of said prong sheaths has mounted thereon a slidable contact and is electrically connectable to its corresponding terminal only by means of the slidable contact; a non-conductive, spring-loaded displaceable peg axially located in a peg cavity in the housing between the prong sheaths, said peg having a larger center portion extending transversely from one prong sheath to the other and having a transverse aperture therein, said peg also having a forward portion of reduced diameter which, when the peg is in its forward position, extends beyond the end of the prong sheaths, said peg also having a rear portion of reduced diameter attached to said slidable contact and containing means for keeping said peg in axial alignment; a peg spring surrounding the rear peg portion positioned in said peg cavity between the end of the peg cavity and the larger center portion of the peg; compressible peg locking means tensioned in the transverse aperture of the central portion of the peg locking the peg in a forward displaceable position; the prong sheaths, slidable contact, electrical terminals and displaceable peg being so positioned that the socket can be energized only when the prongs of an electrical plug are inserted into the prong sheaths compressing the peg locking means allowing the plug to displace the peg backwardly into the peg cavity thereby compressing the peg spring and moving the slidable contact backwardly on the prong sheath and into contact with its electrical terminal thereby energizing the socket until the plug is removed allowing the peg spring to move the peg and slidable contact forward de-energizing the socket and locking the peg in its forward position between the prong sheaths by the peg locking means.

2. A safety socket assembly according to claim 1, wherein the compressible peg locking means consists of a spring positioned in the transverse aperture of the central portion of the peg having solid tips attached at either end.

3. A safety socket assembly according to claim 2, wherein the tips are configured to extend through the facing prong sheath apertures and to recede inwardly when contacted by the prongs of an electrical plug.

4. A safety socket assembly according to claim 3, wherein the slidable contact fits about the outside of the prong sheath.

5. A safety socket assembly according to claim 4, wherein the slidable contact has an outwardly extending tap adapted to contact its corresponding terminal upon backward movement of the slidable contact.

6. A safety socket assembly according to claim 5, wherein the slidable contact has an inwardly extending tab having an aperture therein adapted to receive the rear portion of the peg.

7. A safety socket assembly according to claim 6, wherein the diameter of the central portion of the peg is larger than the distance between the prong sheaths and opposing sides of the central portion of peg have been flattened to fit between the prong sheaths.

* * * * *